US006573467B1

(12) United States Patent
Nakanishi et al.

(10) Patent No.: US 6,573,467 B1
(45) Date of Patent: Jun. 3, 2003

(54) SWITCH CONTACT STRUCTURE

(75) Inventors: Kiyoshi Nakanishi, Kanagawa (JP); Takao Monden, Kanagawa (JP); Yoshitomo Ishikawa, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/763,123

(22) PCT Filed: Jun. 16, 2000

(86) PCT No.: PCT/JP00/03938

§ 371 (c)(1),
(2), (4) Date: Jun. 28, 2001

(87) PCT Pub. No.: WO00/79553

PCT Pub. Date: Dec. 28, 2000

(30) Foreign Application Priority Data

Jun. 18, 1999 (JP) ..... 11-172880

(51) Int. Cl.[7] ..... H01H 13/70

(52) U.S. Cl. ..... 200/406; 200/516; 200/512; 200/5.7

(58) Field of Search ..... 200/16 R, 16 A, 200/16 B, 292, 406, 341, 239, 512, 516, 517, 520

(56) References Cited

U.S. PATENT DOCUMENTS 5,268,542 A * 12/1993 Voll ..... 200/5 A
5,313,027 A * 5/1994 Inoue et al. ..... 200/5 A
5,510,584 A * 4/1996 Norris ..... 200/5 A
5,924,555 A * 7/1999 Sadamori et al. ..... 200/512

FOREIGN PATENT DOCUMENTS

| | | | |
|---|---|---|---|
| JP | 56-134641 | 10/1981 | ..... H01H/19/08 |
| JP | 2-126524 | 5/1990 | ..... H01H/13/48 |
| JP | 3-230431 | 10/1991 | ..... H01H/13/70 |
| JP | 4-31225 | 3/1992 | ..... H01H/13/02 |
| JP | 4-68311 | 6/1992 | ..... H01H/1/06 |
| JP | 5-74267 | 3/1993 | ..... H01H/13/52 |
| JP | 8-241647 | 9/1996 | ..... H01H/13/70 |

* cited by examiner

*Primary Examiner*—Michael Friedhofer
(74) *Attorney, Agent, or Firm*—Pearne & Gordon LLP

(57) ABSTRACT

A contact structure of a switch comprises a first contact (1), and one or more doughnut-like second contacts (2) surrounding the first contact (1), and the second contacts (2) are provided with one or more band-like contacts (3*a*), (3*b*), (3*c*), (3*d*) extending to the opposite side from the first contact (1). With this structure, an area of a metal pattern portion of the second contact (2) becomes smaller as compared with prior art. In a compact electronic device used for a numeric keypad of a mobile telephone or the like, the contact structure can be reduced in size and weight to the utmost and resources can be saved to the utmost.

5 Claims, 11 Drawing Sheets

SWITCH CONTACT STRUCTURE

TECHNICAL FIELD

The present invention relates to a contact structure of a switch for a compact electronic device used for a numeric keypad of a mobile telephone or the like, and more particularly, to a contact structure of a switch that is reduced in size and weight to the utmost and in which resources are saved to the utmost.

BACKGROUND ART

In a numeric keypad for a data inputting apparatus of OA equipment and AV equipment, a facsimile machine, and a telephone terminal apparatus including a mobile telephone as shown in FIG. 9, a keyboard switch using a substantially pan-like diaphragm made of metal or conductive material such as conductive plastic having spring characteristics is conventionally employed.

The keyboard switch will be explained while taking a mobile telephone shown in FIG. 9 as an example. A printed board 26 shown with a broken line is disposed in a case 27. Circle contacts 21 that are first contacts shown also with broken lines and diaphragms 25 shown with broken lines for bringing C-contacts or annular contacts that are second contacts into conduction are disposed in the printed board 26.

The case 27 is provided with keys 20 that can be pushed down, and if the key 20 is pushed down, a central portion of the diaphragm 25 is pushed and the circle contact 21 and the C-contact or annular contact are brought into conduction.

Details of a contact structure for a keyboard switch is disclosed in Japanese Patent Application Laid-open No. 5-74267. As shown in FIG. 10 for example, the circle contact 21 that is the first contact is disposed on the printed board 26, the circle contact 21 is surrounded by the C-contact 22 that is the second contact, the diaphragm 25 is placed on the C-contact 22 and fixed onto the printed board 26 through a single-sided adhesive sheet 28.

Then, as shown in FIG. 11, the central portion 25*a* of the diaphragm of the conductor is pushed and deformed by the key 20, and the circle contact 21 that is the first contact and the C-contact 22 that is the second contact are brought into conduction.

A shape of the contact may be annular instead of C-shape as disclosed in Japanese Patent Application Laid-open No. 3-230431. FIG. 12 schematically shows the circle contact 21 and the annular contact 22 of the printed board 26 accommodated in the case 27 of a mobile telephone shown in FIG. 9.

According to these conventional contact structures, however, the central portion of the conductive diaphragm is pushed and deformed to bring the central circle contact and the C-contact into conduction, and the conduction between the contacts is cut off by a restoring force of the diaphragm.

Therefore, it is necessary to make an outer shape of the diaphragm large in some degrees. Even if the central circle contact is made small, a size of the C-contact corresponds to that of an outer periphery of the diaphragm.

In recent compact electronic device such as a mobile telephone, a weight of an entire device is evaluated as an important index for carrying performance. Therefore, every part need be reduced in weight to achieve the weight reduction in gram.

Thus, size and weight reducing utmost method is required for a contact using metal material. A problem is how to reduce the weight while enhancing or maintaining the performance. On the other hand, it has become widely and increasingly valued in effectively using resources or recycle, and it is required to save metal such as gold that is rare metal.

It is an object of the present invention to provide a contact structure of a switch for a compact electronic device used for a numeric keypad of a mobile telephone or the like that can be reduced in size and weight to the utmost and in which resources can be saved to the utmost.

DISCLOSURE OF THE INVENTION

To achieve the above object, according to the present invention, there is provided a contact structure of a switch comprising a first contact, and one or more second contacts surrounding the first contact, wherein the second contacts are provided with one or more band-like contacts extending to the opposite side from the first contact.

The band-like contacts may extend radially with respect to a center of the first contact, or the band-like contacts may extend into fan-like shape with respect to a center of the first contact.

Since the one or more second contacts surrounding the first contact are provided with the one or more band-like contacts extending to the opposite side from the first contact, there is a merit that an area of the metal pattern portion of the second contact can be made smaller as compared with the prior art.

Further, if the band-like contacts extend radially with respect to a center of the first contact, there is a merit that a larger number of band-like contacts having smaller width can be disposed.

Further, if the band-like contacts extend into fan-like shape with respect to a center of the first contact, there is a merit that the area of the metal pattern portion of the second contact becomes wider as separating from the center of the first contact.

Further, the present invention provides a contact structure of a switch comprising a first contact, one or more second contacts surrounding the first contact, and a pan-like diaphragm comprising a conductor, wherein the second contacts are provided with one or more band-like contacts extending to the opposite side from the first contact, an outer periphery of the pan-like diaphragm is placed on the band-like contacts extending from the second contacts and brought into conduction with the band-like contacts, a center of the pan-like diaphragm is pushed down and bent, the center of the pan-like diaphragm is brought into contact with the first contact and into conduction therewith, thereby bringing the switch into conduction.

The band-like contacts may extend radially with respect to a center of the first contact, or the band-like contacts may extend into fan-like shape with respect to a center of the first contact.

The switch portion comprises the first contact, the one or more second contacts surrounding the first contact, and the pan-like diaphragm comprising a conductor, the second contacts are provided with one or more band-like contacts extending to the opposite side from the first contact, an outer periphery of the pan-like diaphragm is placed on the band-like contacts extending from the second contacts and brought into conduction with the band-like contacts, a center of the pan-like diaphragm is pushed down and bent, the center of the pan-like diaphragm is brought into contact with the first contact and into conduction therewith, thereby bringing the switch into conduction. Therefore, there is a merit that switch can be brought into conduction even if the second contacts do not correspond to the entire portion of the outer periphery of the diaphragm.

Further, if the band-like contacts extend radially with respect to a center of the first contact, there is a merit that a larger number of band-like contacts having smaller width can be disposed.

Further, if the band-like contacts extends into fan-like shape with respect to a center of the first contact, there is a merit that the area of the metal pattern portion of the second contact becomes wider as separating from the center of the first contact.

BEST MODE FOR CARRYING OUT THE INVENTION

Embodiments of the present invention will be explained using FIGS. 1 to 8 below.

FIRST EMBODIMENT

Figure 1A:
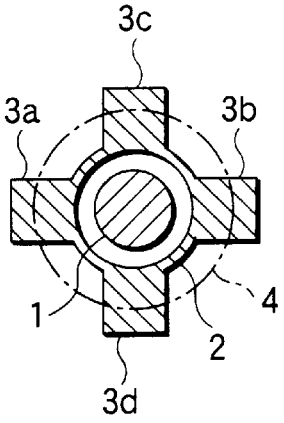
FIG. 1A is a plan view of a contact structure of a switch according to a first embodiment of the present invention.

FIG. 1A shows shape of contacts of a first embodiment of the invention. FIG. 1A shows a circle contact 1 that is a first contact, an annular contact 2 that is a second contact, and band-like contacts 3*a*, 3*b*, 3*c* and 3*d* extended from the doughnut contact 2 that is a second contact. The band-like contacts 3*a*, 3*b*, 3*c* and 3*d* are connected to one another through the doughnut contact 2.

In FIG. 1A, a reference number 4 does not represent a contact, but this shows, with a broken line, a position where an outer periphery of a diaphragm 5 comes into contact for explanation.

Figure 1B:
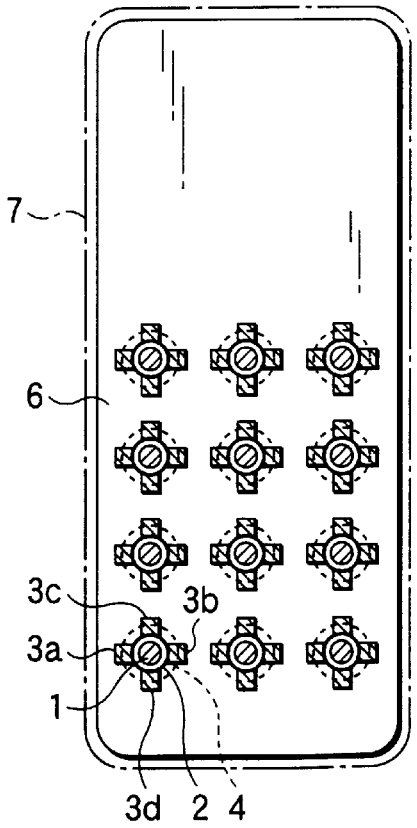
FIG. 1B is a schematic plan view of a printed board of a mobile telephone having the contact structure of the switch of the first embodiment of the invention.

FIG. 1B shows shape of the contacts shown in FIG. 1A and a printed board of a mobile telephone used for 12 keys including numeric keys and special keys. FIG. 1B shows the printed board 6 and a case 7 with phantom lines of a mobile telephone.

Figure 2C:
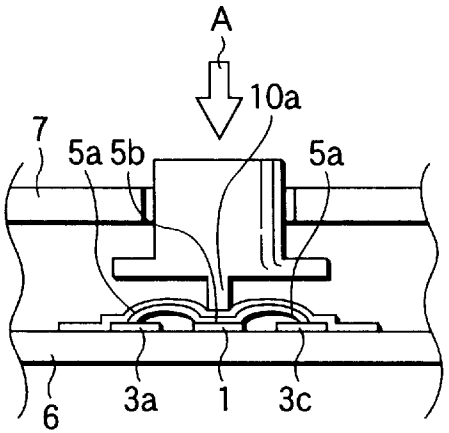
FIG. 2C is a sectional view showing the contact structure of the switch of the first embodiment of the invention after the contact structure was pushed down.
Figure 2B:
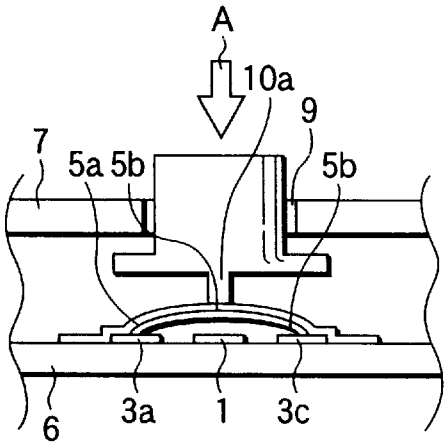
FIG. 2B is a sectional view showing the contact structure of the switch of the first embodiment of the invention when the contact structure is being pushed down.
Figure 2A:
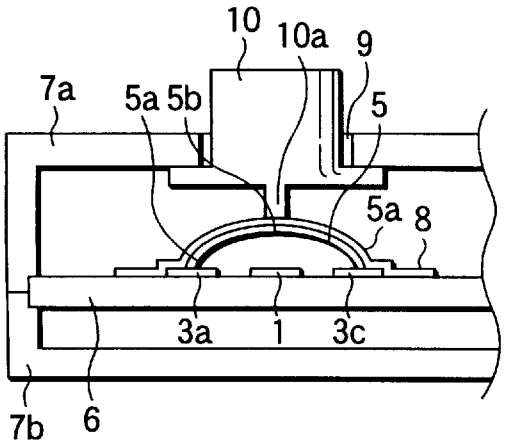
FIG. 2A is a sectional view showing the contact structure of the switch of the first embodiment of the invention before the contact structure is pushed down.

A relation between the contacts 1, 2, 3 and the diaphragm 5 is shown in a sectional view of FIG. 2. In FIG. 2A, the printed board 6 is sandwiched between cases 7*a* and 7*b*. The printed board 6 is provided with the circle contact 1 that is the first contact explained in FIG. 1, and is provided with the band-like contacts 3*a* and 3*c* connected to one another through the doughnut contact (not shown) that is the second contact surrounding the circle contact 1.

An outer peripheral portion 5*a* of the diaphragm 5 that is a conductor is placed on the band-like contacts 3*a* and 3*c* extended from the doughnut contact 2 on both sides of the circle contact 1 and electrically conducted.

The diaphragm 5 is fixed to the printed board 6 through a single-sided adhesive sheet 8. The case 7*a* has a hole 9, and a key 10 is vertically movably provided in the hole 9. The key 10 is provided at its lower surface with a projection 10*a* that buts against a center 5*b* of the diaphragm 5.

As shown in FIGS. 2B and 2C, if the key 10 is pushed down as shown with arrows A, the projection 10*a* of the key pushes down the center 5*b* of the diaphragm and finally, the center 5*b* of the diaphragm is brought into contact with the circle contact 1 and conducted with the latter. That is, the circle contact 1 and the band-like contacts 3 extended from the doughnut contact 2 are brought into conduction through the diaphragm 5, and the switch is turned ON.

As shown in the sectional view of FIG. 2, outer shape of the diaphragm 5 must be made large in some degree so as to secure a constant deformation amount. An inner diameter of the doughnut contact does not correspond to the outer peripheral portion of the diaphragm 5 unlike the prior art, and the diaphragm abuts against the band-like contacts 3*a* and 3*c* extended from the doughnut contact to opposite side from the circle contact 1. Therefore, the inner diameter of the doughnut contact can be made larger only slightly than the outer shape of the circle contact 1.

Figure 12:
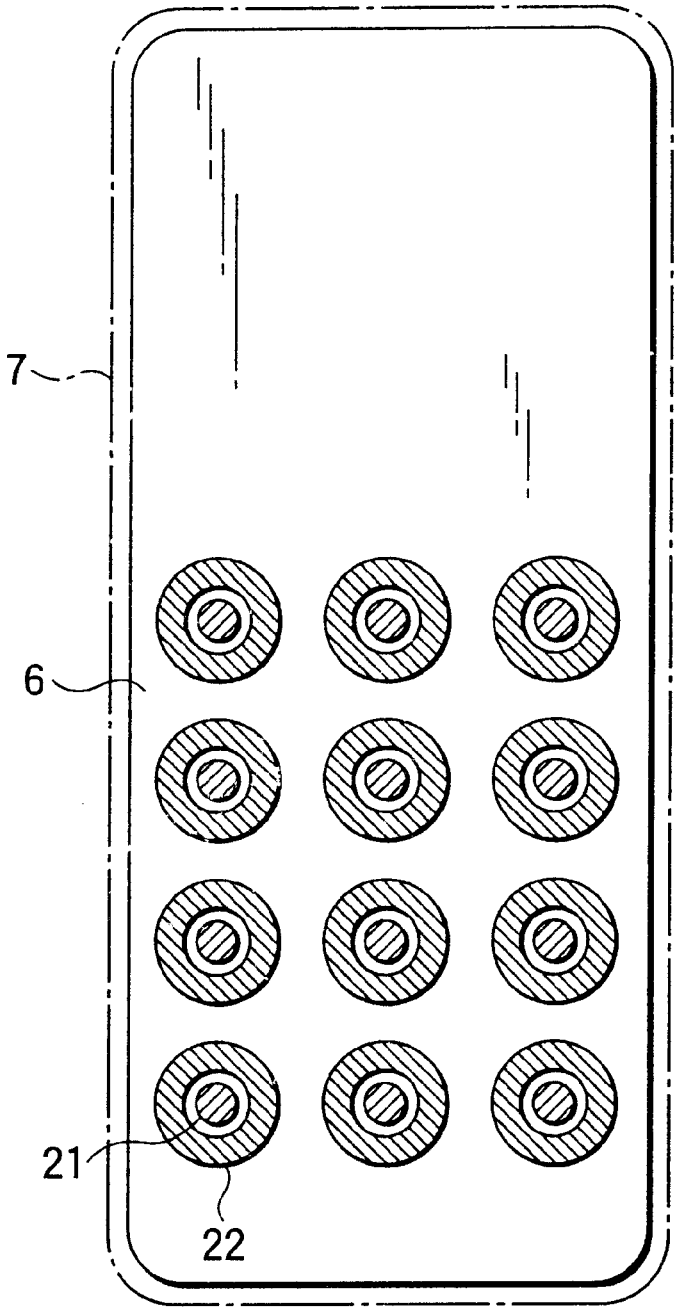
FIG.12 PRIOR ART
FIG. 12 is a plan view schematically showing a printed board of a conventional mobile telephone.

Electrically, both the conventional doughnut-like contact and the doughnut-like second contact provided with the band-like contact surround the first contact. If FIGS. 12 and 1B which are electrically equivalent are compared, it is apparent that a two-dimensional occupied area of the doughnut contact becomes smaller, and the object of the weight reduction and resource saving can be achieved correspondingly.

SECOND EMBODIMENT

Figure 3:
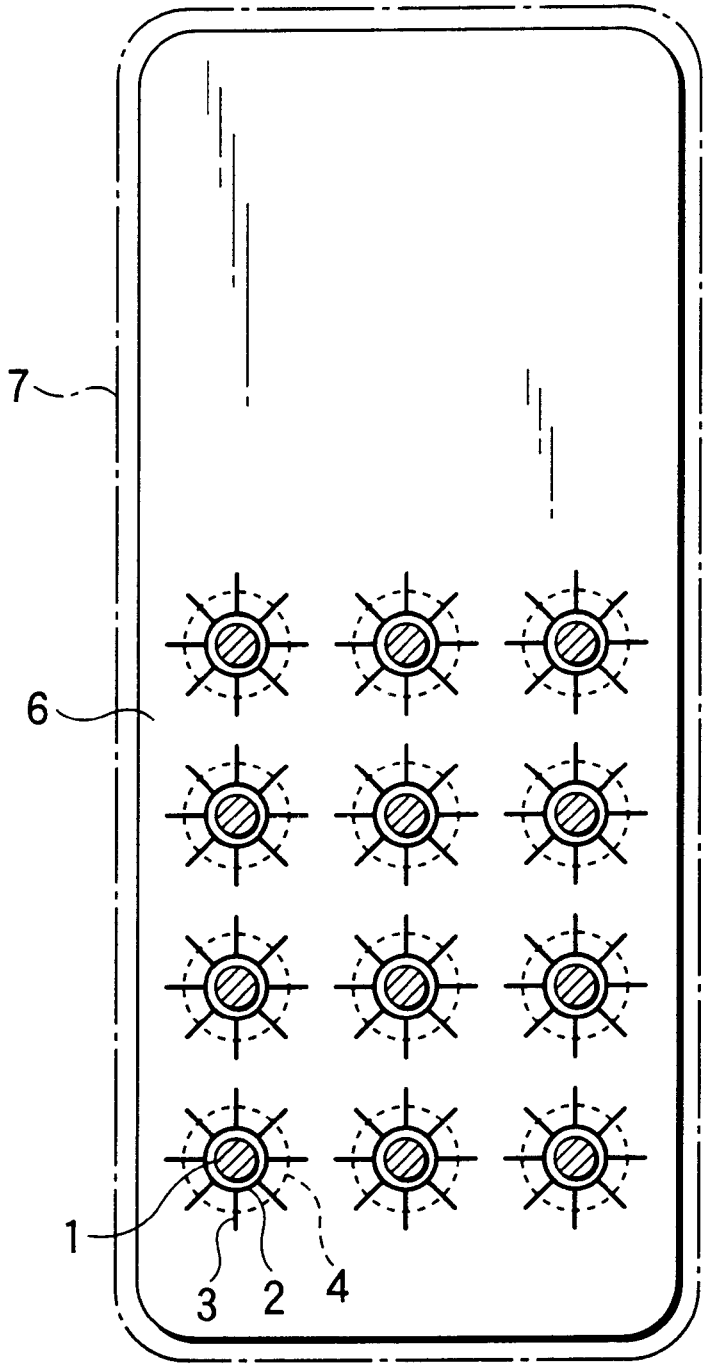
FIG. 3 is a plan view of a contact structure of a switch according to a second embodiment of the invention.

FIG. 3 shows a second embodiment of the invention. The second contact 2 is provided with the band-like contacts 3 extending radially from the second contact 2 with respect to a center of the first contact toward opposite side from the latter. A larger number of band-like contacts 3 having smaller width can be disposed and thus, even if a shape of the outer peripheral portion 5*a* of the diaphragm 5 is varied more or less due to production variation, any of the large number of bands and the outer periphery of the diaphragm come into contact with each other to secure the conduction.

THIRD EMBODIMENT

Figure 4:
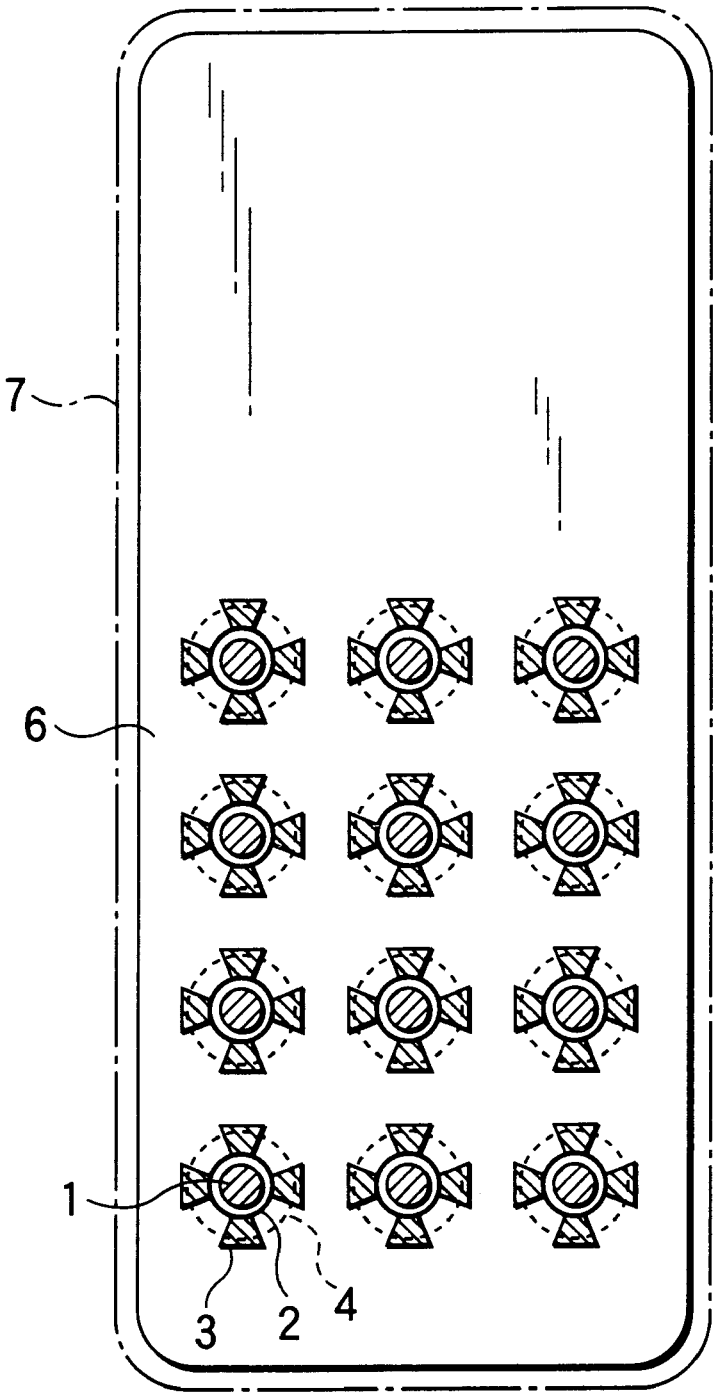
FIG. 4 is a plan view of a contact structure of a switch according to a third embodiment of the invention.

FIG. 4 shows a third embodiment of the invention. The second contact 2 is provided with band-like contacts 3 extending into a fan-like shape with respect to a center of the first contact toward opposite side from the latter. Since the band-like contact is of the fan-like shape, an area of a metal pattern portion of the second contact becomes wider as separating from the center of the first contact. Therefore, even if a shape of the outer peripheral portion 5*a* of the diaphragm 5 is varied more or less due to production variation, any of the large number of bands and the outer periphery of the diaphragm come into contact with each other to secure the conduction. It is possible to previously determine that a large number of band-like contacts extending radially should be employed or the band-like contacts should be formed into the fan-like shape, in accordance with the actual state of production of the diaphragm.

FOURTH EMBODIMENT

Figure 5:
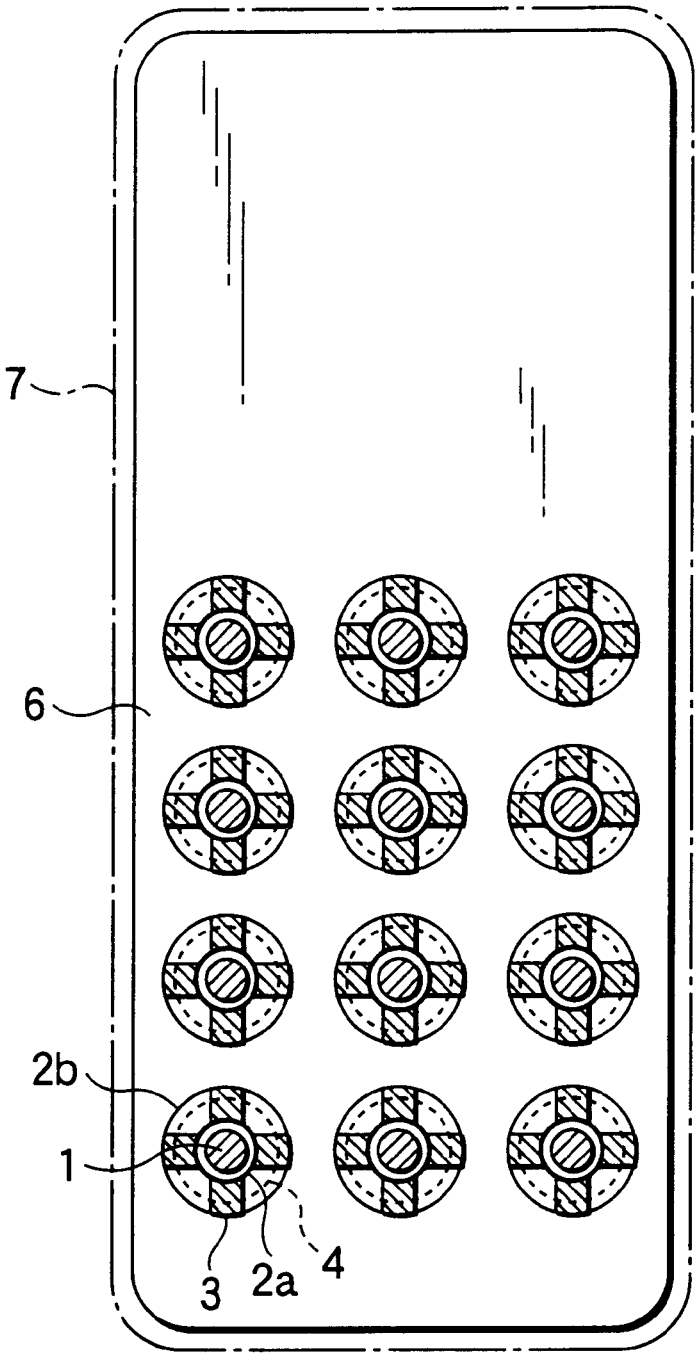
FIG. 5 is a plan view of a contact structure of a switch according to a fourth embodiment of the invention.

FIG. 5 shows a fourth embodiment of the invention. As the second contact, two doughnut contacts 2*a* and 2*b* are concentrically provided. Even if a width of a lead of a wire of the printed board 6 is made as thin as 0.1 to 0.2 mm, since a plurality of the doughnut contacts are provided, it is possible to secure the conduction state of the switch even if one of the doughnut contacts breaks.

FIFTH EMBODIMENT

Figure 6:
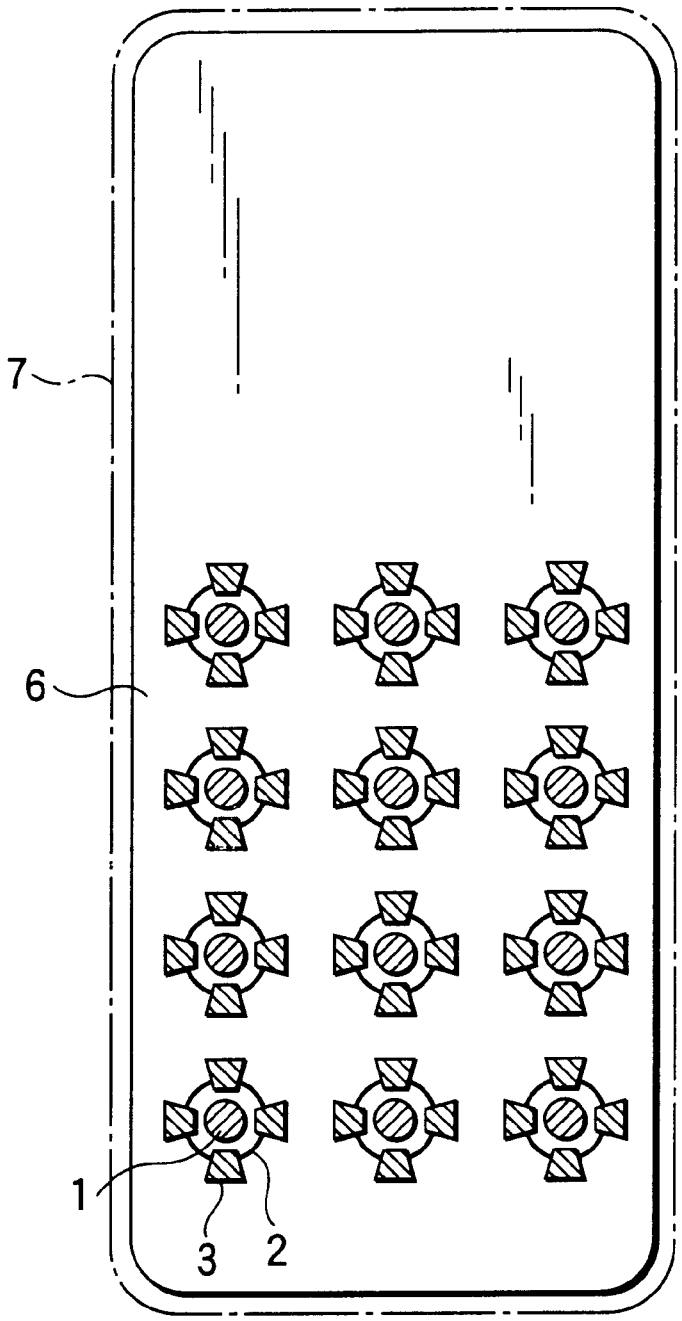
FIG. 6 is a plan view of a contact structure of a switch according to a fifth embodiment of the invention.

FIG. 6 shows a fifth embodiment of the invention. The band-like contact intersects with the doughnut contact 2 that is the second contact. The band-like contact also extends inside the doughnut contact 2 that is the second contact, i.e., on the side of the circle contact. As compared with the conventional example shown in FIG. 12, it is apparent that a two-dimensional occupied area of the doughnut contact becomes smaller, and the object of the weight reduction and resource saving can be achieved correspondingly.

SIXTH EMBODIMENT

Figure 7:
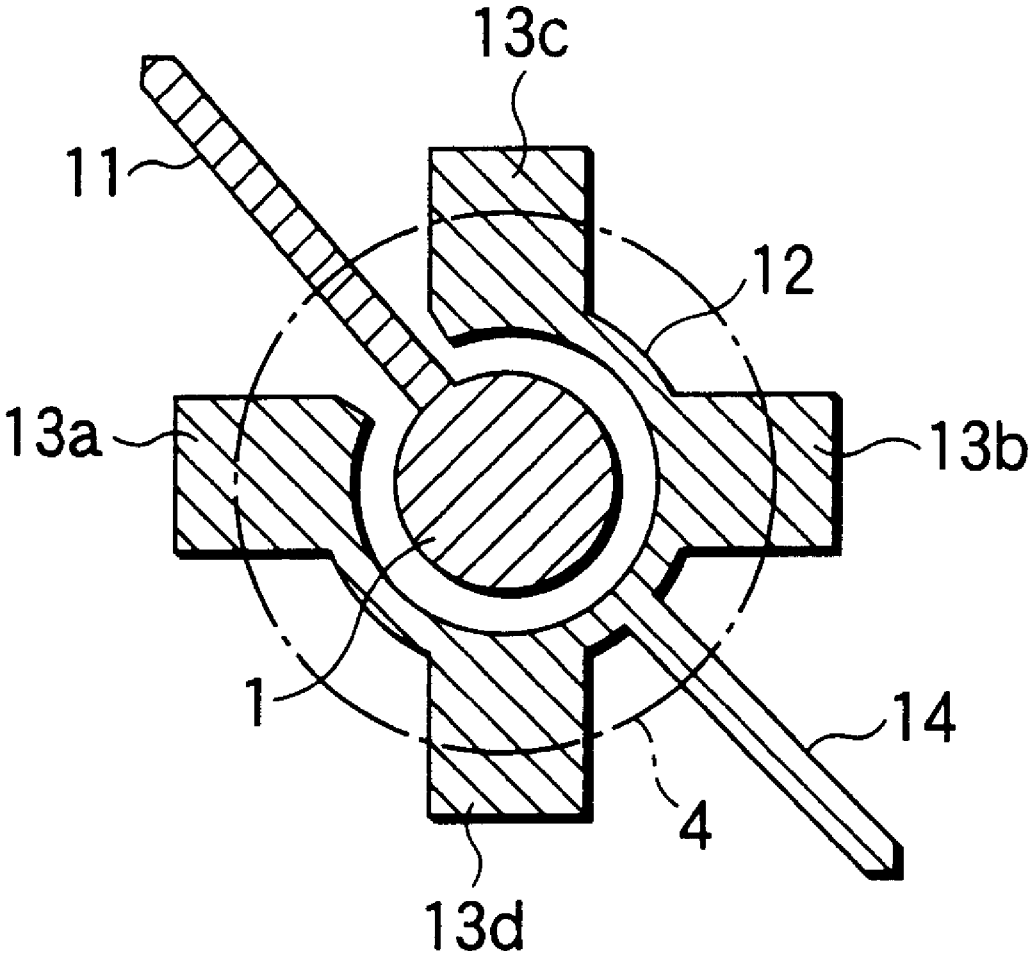
FIG. 7 is a plan view of a contact structure of a switch according to a sixth embodiment of the invention.

FIG. 7 shows a sixth embodiment of the invention. FIG. 7 shows a circle contact 1 that is a first contact, a lead 11 led out from the circle contact 1, a horseshoe contact 12 that is a second contact, and band-like contacts 13*a*, 13*b*, 13*c* and 13*d* extended from the horseshoe contact 12, and a lead 14 led out from the horseshoe contact 12.

Figure 8:
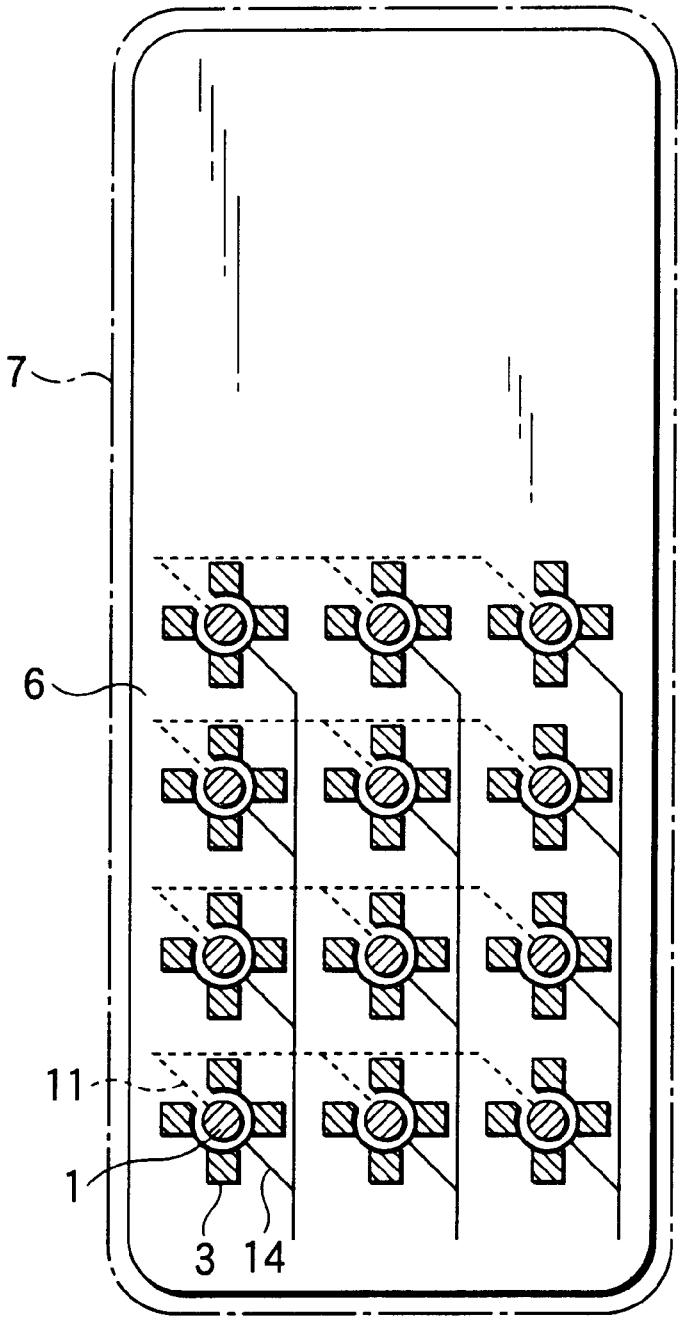
FIG. 8 is a schematic plan view of a multilayer printed board of a mobile telephone having the contact structure of the switch of the sixth embodiment of the invention.
Figure 9:
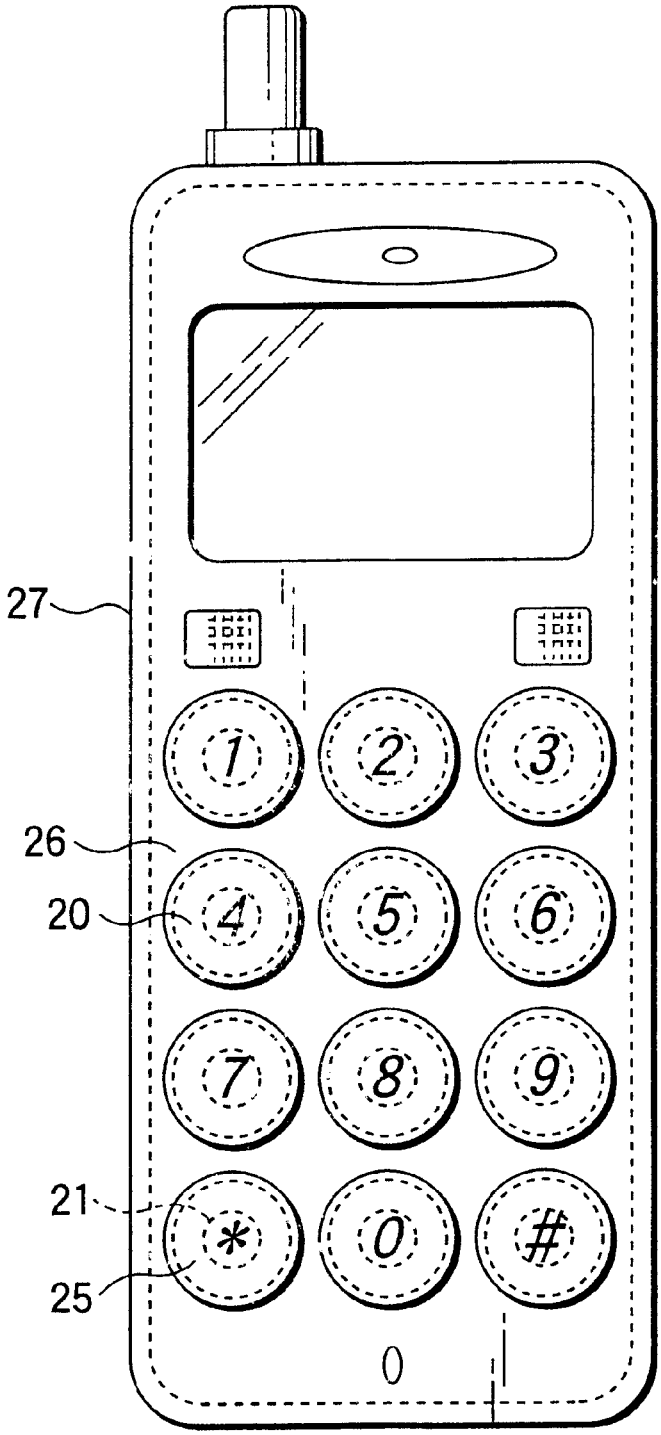
FIG.9 PRIOR ART
FIG. 9 is a plan view of a conventional mobile telephone.
Figure 10:
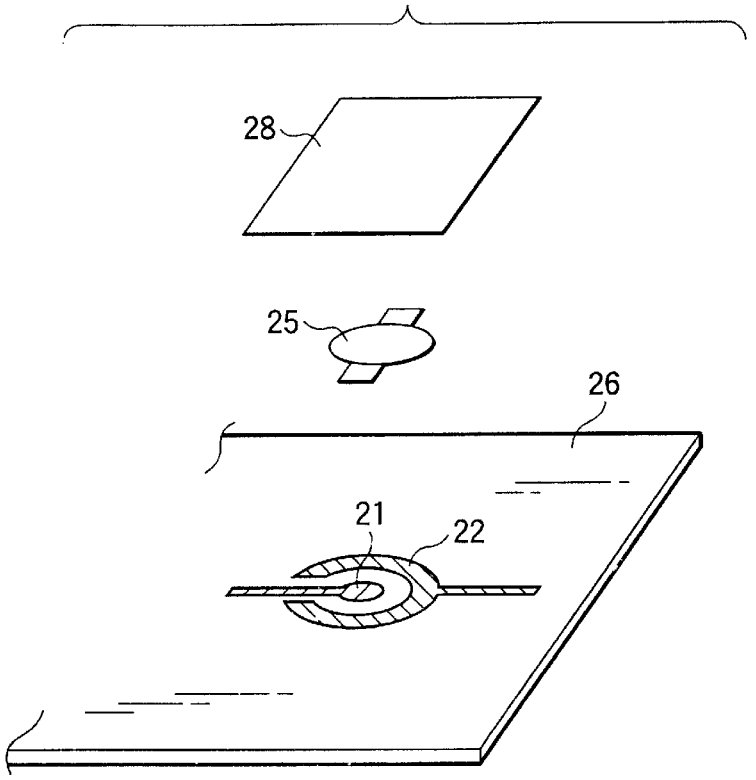
FIG.10 PRIOR ART
FIG. 10 is an exploded perspective view showing a conventional contact structure of the switch.
Figure 11:
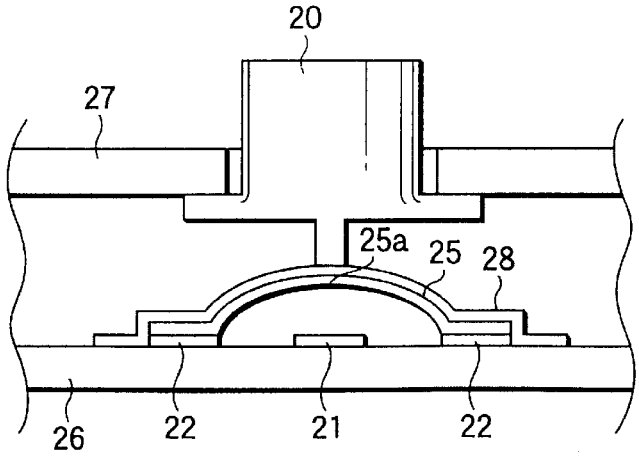
FIG.11 PRIOR ART
FIG. 11 is a sectional view of the conventional contact structure of the switch.

The band-like contacts 13*a*, 13*b*, 13*c* and 13*d* are connected to one another through the horseshoe contact 12 that is the second contact. In FIG. 7, a reference number 4 does not represent a contact, but this shows, with a broken line, a position where an outer periphery of a diaphragm comes into contact for explanation. When the contacts are actually formed on the printed board, a multilayer printed board is used so that the lead 11 led out from the circle contact does not come into contact with the lower surface of the diaphragm when the diaphragm is placed on the position 4 of FIG. 7. FIG. 8 shows the multilayer printed board in which the contact structure of FIG. 7 is used for a numeric keypad of a mobile telephone. As shown in FIG. 8, the lead 11 led out from the circle contact 1 is disposed on a lower layer.

Although only the circle contact is shown as an example of the first contact in the above explanation of the embodiment of the invention, the contact may not be limited to circle, and may be triangular, rectangular, or polygonal such as star-like shape, or gourd-shape only if the contact is brought into contact when the center of the diaphragm is pushed down.

INDUSTRIAL APPLICABILITY

As apparent from the above explanation, according to the contact structure of the switch the present invention, the contact structure of the switch comprises a first contact, and one or more second hippocrepian or doughnut-like contacts surrounding the first contact, and the second contacts are provided with one or more band-like contacts extending to the opposite side from the first contact. With this structure, there are merits that an area of a metal pattern portion of the second contact becomes smaller as compared with prior art, and the contact structure can be reduced in size and weight and resources can be saved.

Further, if the band-like contacts extend radially with respect to a center of the first contact, there are merits that a larger number of band-like contacts having smaller width can be disposed and thus, even if the area of the metal pattern portion of the second contact becomes smaller as compared with prior art, the metal pattern portions of the second contacts can be disposed in substantially the same region as the prior art.

Further, if the band-like contacts extend into fan-like shape with respect to a center of the first contact, there are merits that since the area of the metal pattern portion of the second contact becomes wider as separating from the center of the first contact, even if the area of the metal pattern portion of the second contact becomes smaller as compared with prior art, the band-like contact can be provided with the same metal pattern portion as the prior art of the second contact.

Furthermore, according to the present invention, the contact structure of the switch comprises a first contact, one or more second contacts surrounding the first contact, and a pan-like diaphragm comprising a conductor, wherein the second contacts are provided with one or more band-like contacts extending to the opposite side from the first contact, an outer periphery of the pan-like diaphragm is placed on the band-like contacts extending from the second contacts and brought into conduction with the band-like contacts, a center of the pan-like diaphragm is pushed down and bent, the center of the pan-like diaphragm is brought into contact with the first contact and into conduction therewith, thereby bringing the switch into conduction. The switch can be brought into conduction even if the second contacts do not correspond to the entire portion of the outer periphery of the diaphragm. Therefore, there is a merit that the area of the metal pattern of the second contact can be made smaller as compared with the prior art.

Further, if the band-like contacts extend radially with respect to a center of the first contact, there are merits that a larger number of band-like contacts having smaller width can be disposed and the area of the metal pattern portion of the second contact becomes greatly smaller as compared with prior art, the contact structure can be reduced in size and weight to the utmost and resources can be saved to the utmost. Further, even if a shape of the outer peripheral portion 5*a* of the diaphragm 5 is varied more or less due to production variation, any of the large number of bands and the outer periphery of the diaphragm come into contact with each other to secure the conduction.

Further, if the band-like contacts extend into fan-like shape with respect to a center of the first contact, there are merits that since the area of the metal pattern portion of the second contact becomes wider as separating from the center of the first contact, even if the area of the metal pattern portion of the second contact becomes smaller as compared with prior art, the band-like contact can be provided with the same metal pattern portion as the prior art of the second contact. Further, even if a shape of the outer peripheral portion 5*a* of the diaphragm 5 is varied more or less due to production variation, any of the large number of bands and the outer periphery of the diaphragm come into contact with each other to secure the conduction.

What is claimed is:

1. A contact structure of a switch comprising a first contact, at least one second contact surrounding said first contact, and a pan-like diaphragm comprising a conductor, wherein said second contact is provided with at least one band-like contact extending to and opposite side from said first contact, an outer periphery of said pan-like diaphragm is placed only on said band-like contacts extending from said second contact and brought into conduction with said band-like contacts, wherein when a center of said pan-like diaphragm is pushed down and bent, the center of said pan-like diaphragm is brought into contact with said first contact and into conduction therewith, thereby bringing said switch into conduction.

2. A contact structure of a switch according to claim 1, wherein said second contact is provided at the side opposite from said first contact with said band-like contacts extending radially with respect to a center of said first contact.

3. A contact structure of a switch according to claim 1, wherein said second contact is provided at the side opposite from said first contact with said band-like contacts extending into a fan-like shape with respect to a center of said first contact.

4. A mobile phone comprising the contact structure of the switch as claimed in any one of claims 1 to 3.

5. A contact structure of a switch comprising:

a first contact; and a second contact surrounding said first contact, wherein said second contact is provided with band-like contacts, and the band-like contacts have a length extending to an opposite side from said first contact larger than a width perpendicular to the length.

* * * * *